US005542369A

United States Patent [19]

Ingram

[11] Patent Number: 5,542,369

[45] Date of Patent: Aug. 6, 1996

[54] KAYAK SAFETY BUOYANCY STIRRUP

[76] Inventor: Robert T. Ingram, 321 Gordon Dr., Penetanguishene, Ontario, Canada, L9M 1Y2

[21] Appl. No.: 313,821

[22] Filed: Sep. 28, 1994

[51] Int. Cl.[6] ..... B63B 35/71

[52] U.S. Cl. ..... 114/347; 114/362

[58] Field of Search ..... 114/347, 362, 114/364, 123; 441/80, 88, 125

[56] References Cited

U.S. PATENT DOCUMENTS

| | | | |
|---|---|---|---|
| 2,355,757 | 8/1944 | Spanel | 441/40 |
| 2,651,789 | 9/1953 | Newland | 114/362 |
| 2,975,858 | 3/1961 | Billingsley | 114/362 |
| 4,739,720 | 4/1988 | Jarschke | 114/347 |
| 4,838,196 | 6/1989 | Ingram | 114/347 |

FOREIGN PATENT DOCUMENTS

| | | | |
|---|---|---|---|
| 2629042 | 9/1989 | France | 114/362 |

*Primary Examiner*—Sherman Basinger

[57] ABSTRACT

A kayak safety buoyancy stirrup consisting of an adjustable stirrup and an inflatable buoyancy bag flexibly attached to the deck of a kayak: carried on the deck of the kayak and permitting immediate deployment by a kayaker in the water, on either side of the kayak. The buoyancy stirrup has sufficient buoyancy to allow a disabled kayaker to step out of the water immediately to prevent hypothermia and lie across the device and the kayak deck in extreme emergencies, a foot in the stirrup and hands and arms entwined in kayak deck rigging, preventing the kayaker from falling into cold water again. The inflatable buoyancy bag has an air-tight closure mechanism to permit stow-age of bulky, lightweight items. Pouches containing safety equipment such as kayak safety sponsons may be attached to the bag to organize and prevent forgetting of vital safety equipment.

1 Claim, 1 Drawing Sheet

KAYAK SAFETY BUOYANCY STIRRUP

BACKGROUND OF THE INVENTION

1. Field on the Invention

The invention relates to a buoyancy stirrup, flexibly attached to the deck of a kayak, in particular an inflatable buoyancy stirrup always fully or partially inflated while carried on the deck of a kayak; permitting immediate deployment in the water, on either side of the kayak, having sufficient buoyancy for the kayaker to step out of the water to re-enter the kayak or to raise the body out of cold water to prevent death by hypothermia. The buoyancy stirrup cannot capsize the kayak in waves due to a non-rigid attachment to the kayak and bulky, lightweight items may be stowed inside by means of an air-tight closure mechanism.

2. Prior Art

Kayakers have experimented with a rigid kayak paddle having a float on the end of the paddle farthest from the kayak. The other end of the paddle is rigidly attached to the kayak deck and a long sling of rope or webbing is then wound around the paddle shaft close to the kayak or around the cockpit coaming. The float creates a lever out of the paddle for a secure step for the paddler's foot. However paddle shafts have been broken by means of this lever. Also the float rises in waves and recapsizes the paddler on the opposite side by means of this rolling lever, created in waves. The set up of paddle, float and sling takes many minutes. It does not stabilize the kayak in waves but can capsize the kayak by means of the lever created.

Sick, injured, or disabled paddlers cannot swim out of the water to reenter the kayak without the assistance of a step which allows use of the powerful leg muscles. The step device cannot provide a means to re-capsize the kayak or place the kayaker in an unstable position while retrieving the paddle, float and sling, in the same rough conditions of the initial capsize. The only means to stabilize a kayak is provided by Kayak Safety Sponsons with flotation on both sides of the kayak, enabling the kayaker to paddle to safety with capsize protection if the sponsons are left deployed, even without a functional pump or sprayskirt and with a flooded cockpit. (U.S. Pat. No. 4,838,196)

It is desireable to have a means for a sick, injured, or disabled paddler to step out of the water immediately while deploying kayak safety sponsons to stabilize the kayak and while using other safety equipment. It is desirable to enable a kayaker to step immediately out of cold water by means of an inflatable buoyancy stirrup with sufficient buoyancy, as carried on the deck of the kayak, to provide a secure step. The shape and buoyancy of this device enables severely disabled paddlers to create a stable platform lying on both the device and the kayak deck, the stirrup and the paddler's arms entwined in kayak deck rigging preventing the paddler from falling into the water again. It is desireable that the buoyancy stirrup stow lightweight, bulky items in such small craft as kayaks, in order to encourage the public to carry a safety device on their kayak at all times. It is desireable that this safety device have a means to attach pouches for other safety equipment, in order to organize and not forget a sea anchor, flares and radio. It is desireable that this safety device have a variety of flexible attachment points to the kayak in order to best enable paddlers with different disabilities to step out of the water or re-enter the kayak. It is desireable to have flexible, not rigid attachment to the kayak to avoid recapsize of the kayak, whichever side of the kayak the buoyancy stirrup is deployed.

SUMMARY OF THE INVENTION

The present invention reduces the problems of the prior art by providing a safety buoyancy stirrup which is carried inflated or semi-inflated on the deck of the kayak for immediate use on either side of the kayak to step out of the water, while deploying safety sponsons and re-entering the kayak, or using other safety equipment. The buoyancy stirrup, on only one side of a kayak, cannot re-capsize a kayak due to use of flexible attachment to the kayak, not rigid attachment. A variety of flexible attachment points enable the needs of different disabled paddlers, to be accommodated, to provide the easiest means to step out of the water.

The buoyancy stirrup, according to the invention consists of an adjustable strap or stirrup attached to an inflatable buoyancy bag. A quick-release buckle prevents possible ensnaring of the paddler's foot as well as the adjustable feature above. A variety of possible flexible attachment points are attached to the above inflatable bag. An air-tight closure mechanism permits stowing of lightweight, bulky items; a convenience for small kayaks which encourages carrying this safety device in the deck of a kayak. Attachment points on the buoyancy bag permit its' use as an organizer to which pouches can be attached to carry other safety equipment such as a radio, sea anchor, flares or safety sponsons to stabilize the kayak.

The invention, as exemplified by a preferred embodiment, is described with reference to the drawings.

DETAILED DISCLOSURE

Figure 1:
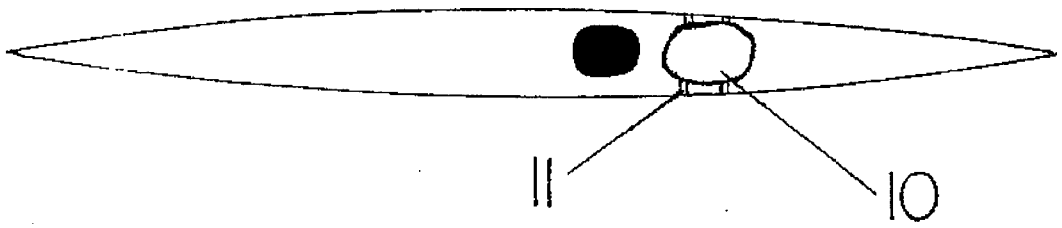
FIG. 1 is a simplified top view of the buoyancy stirrup attached to the rear deck of the kayak, ready for deployment on either side of the kayak.
Figure 2:
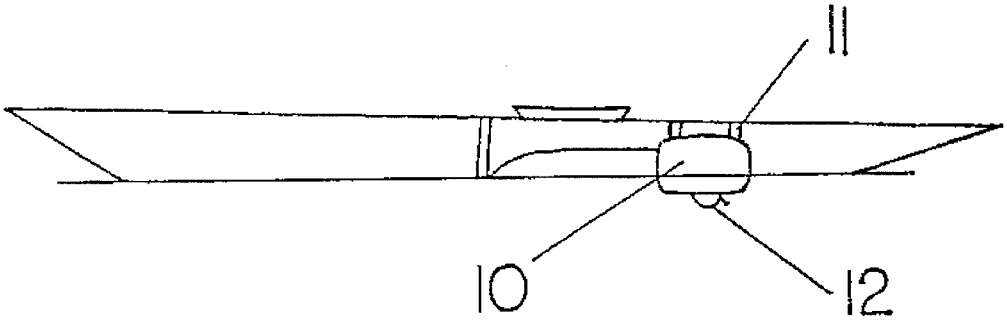
FIG. 2 is a simplified side elevation of the buoyancy stirrup deployed in the water, flexibly attached to the kayak which has safety sponsons attached and inflated, ready for re-entry.
Figure 3:
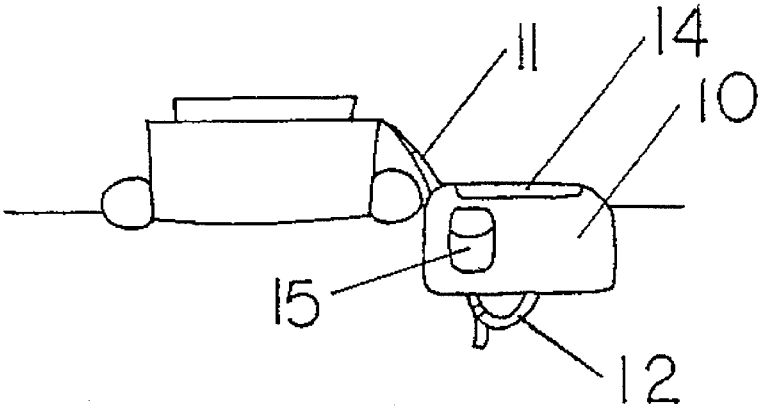
FIG. 3 is a simplified tranverse section showing the buoyancy stirrup in full immersion, under the weight of a paddler using the stirrup to step up into the kayak from the water.

FIGS. 1 through 3

Referring to FIGS. 1 through 3 kayak safety buoyancy stirrup 10 according to the invention is flexibly attached to the rear deck of the kayak close to the cockpit by means of flexible attachments 11. The kayak safety buoyancy stirrup 10 is deployed on either side of the kayak to enable the kayaker to step out of the water. The kayak safety buoyancy stirrup 10 has a quick-release adjustable stirrup 12 into which the paddler places a foot, normally the foot most distant from the kayak. The kayak safety buoyancy stirrup 10 is flexibly attached to the kayak while in the water by flexible clips or quick-release, adjustable and flexible buckles 11. Air-tight closure mechanism 14 permits stowage of lightweight, bulky items within the buoyancy bag.

The buoyancy stirrup can be unclipped on one side of the deck by the paddler in the water in order for the buoyancy stirrup to be removed from the deck and deployed on the side of the kayak where the paddler is in the water. The shape of the buoyancy bag is not a cube but slightly longer on one dimension. This affords better stability to keep the paddler's body out of the water. In severely disabled cases, the foot in the stirrup and the paddler's hands and arms entwined in kayak deck rigging can quickly create a crude raft to keep the paddler's body out of the water and prevent death by hypothermia.

OPERATION

Referring to FIGS. 1 through 3 it can be seen that the kayak safety buoyancy stirrup is carried normally on the rear deck of the kayak, within close reach of the kayaker seated in the cockpit in order to have access to safety gear stowed in pouches attached to the buoyancy bag, or to have access, in calm water, to bulky but lightweight clothing stowed inside the buoyancy bag, by means of the air-tight closure mechanism 14. The buoyancy of the bag is intended to be adequate to provide a secure means to step out of the water when fully inflated, stowed only with bulky but lightweight items. The buoyancy bag might also be semi-inflated, requiring only about 6 puffs of air, or 30 seconds to fully inflate orally. The buoyancy bag may also be equipped with a compressed air cartridge to fully inflate in seconds from a fully deflated state.

The flexible means of attachment to the kayak 1t enables the buoyancy stirrup to be quickly deployed from the rear deck, on either side of the kayak, without risking capsize in waves since the buoyancy bag is free to rise in waves without tipping the kayak. The flexible means of attachment 1t enables the buoyancy stirrup to be quickly retrieved and restored to the rear deck without risking recapsize, especially if kayak safety sponsons remain deployed for stability and protection against re-capsize. Attached pouch for safety equipment 15 may be used to stow safety sponsons and other safety equipment.

The safety buoyancy stirrup is normally carried on the rear deck of a kayak because of limited wind resistance, behind the paddler and the rear deck is usually much lower than the forward deck to facilitate re-entry into the kayak. However the attachment points of the buoyancy stirrup enable its' deployment alongside the cockpit as well, with flexible attachments 11 both fore and aft of the cockpit area being possible. Never the less it must be understood that the buoyancy stirrup cannot stabilize the kayak like safety sponsons, which snugly attach to both sides of the kayak, providing flotation to both sides. Neither can the buoyancy stirrup provide capsize protection like safety sponsons which permit paddling to safety with a flooded cockpit, if left deployed. The buoyancy stirrup provides a quick means for a disabled paddler to step out of cold water quickly, if unable to swim out and re-enter a kayak stabilized with safety sponsons. The buoyancy stirrup is designed to not destabilize a kayak in waves, although deployed on one side only, due to flexible attachments 11. In the interest of back-up safety, the buoyancy stirrup is flexibly attached to the kayak by more than one flexible means of attachment. Similarly more than one adjustable stirrup may be attached to the buoyancy bag for back-up safety.

I claim:

1. A kayak and a safety buoyancy stirrup for use on the kayak for enabling a user of the kayak to return to the kayak from the water in which the kayak is located without re-capsizing the kayak, said kayak having a rear deck, a cockpit and sides, said kayak and safety buoyancy stirrup comprising:

an inflatable buoyancy bag, said bag having an air-tight closure mechanism, said closure mechanism allowing for stowage within said bag of lightweight, bulky items, said bag having sufficient buoyancy such that when it is deployed in the water said bag will support a user of the kayak so as to enable the user of the kayak to enter the kayak from the water without capsizing the kayak;

a safety buoyancy stirrup, said stirrup being adjustable and being attached directly to said bag such that when said bag is deployed in the water said stirrup depends downwardly from said bag, said stirrup being of sufficient size to receive a foot of a user of the kayak such that the user can use said stirrup and said bag for support and for entry into the cockpit of the kayak;

and a plurality of flexible means of attachment for securing said bag to the rear deck of the kayak within reach of a user of the kayak seated in the cockpit of the kayak, said flexible means of attachment enabling a user of the kayak to deploy said bag from the rear deck of the kayak to either side of the kayak such that the bag is floating in the water with said stirrup depending downwardly into the water enabling a user of the kayak to place a foot into said stirrup and enter the kayak without capsizing the kayak.

* * * * *